US005458065A

United States Patent [19]

Catlliau et al.

[11] Patent Number: 5,458,065

[45] Date of Patent: Oct. 17, 1995

[54] TOOL FOR INSTALLING A SPRING RAIL FASTENER

[75] Inventors: Joël Catlliau, Faches Thumesnil; Christian Rudowski, Emerchicourt, both of France

[73] Assignee: Allevard, Saint Cloud, France

[21] Appl. No.: 167,922

[22] PCT Filed: Jun. 18, 1992

[86] PCT No.: PCT/FR92/00550

§ 371 Date: Apr. 7, 1994

§ 102(e) Date: Apr. 7, 1994

[87] PCT Pub. No.: WO93/00478

PCT Pub. Date: Jan. 7, 1993

[30] Foreign Application Priority Data

Jun. 21, 1991 [FR] France ..... 91 07682

[51] Int. Cl.[6] ..... E01B 29/24

[52] U.S. Cl. ..... 104/2; 104/17.2

[58] Field of Search ..... 104/2, 17.2

[56] References Cited

U.S. PATENT DOCUMENTS

| | | | |
|---|---|---|---|
| 4,068,593 | 1/1978 | Leeves | 104/17.2 X |
| 4,320,707 | 3/1982 | McIlrath | 104/17.2 X |
| 4,479,440 | 10/1984 | Burr et al. | 104/17.2 X |
| 5,165,346 | 11/1992 | Piekarski | 104/17.2 |
| 5,191,838 | 3/1993 | Hansen | 104/2 |

FOREIGN PATENT DOCUMENTS

| | | | |
|---|---|---|---|
| 2621619 | 4/1989 | France . | |
| 2683556 | 3/1993 | France | 104/17.2 |
| 2129036 | 10/1982 | United Kingdom | 104/17.2 |

*Primary Examiner*—Robert J. Oberleitner
*Assistant Examiner*—S. Joseph Morano
*Attorney, Agent, or Firm*—Leydig, Voit & Mayer

[57] ABSTRACT

A tool for installing a spring rail fastener includes a main arm whose bottom end is provided with a toe adapted to fit over one of the angled axial ends of the fastener. The main arm is connected near its bottom end, above its toe and by way of a hinge having a transverse pin, to a secondary arm. The secondary arm includes a short first length adapted to be inserted into the housing of an anchoring insert, a second length forming a U-shape bent through 180°, a third length that is substantially parallel to the first length and on which the hinge is mounted, and a fourth length extending outwardly and downwardly in inclined manner relative to the third length and terminating in a curved zone.

3 Claims, 1 Drawing Sheet

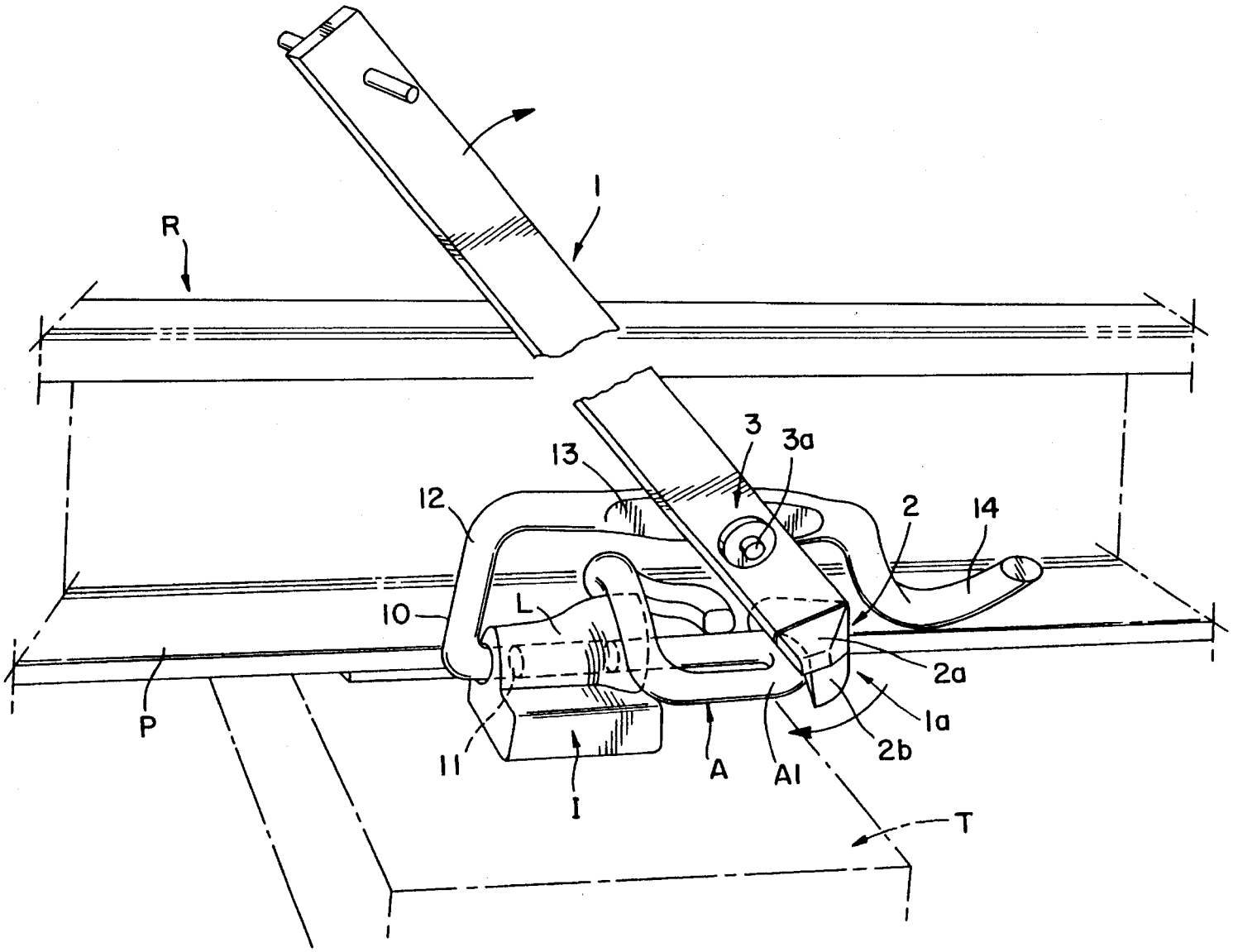
14
2
3a
3
13
12
10
R
I
L
11
A
A1
2b
1a
2a
T
P

TOOL FOR INSTALLING A SPRING RAIL FASTENER

BACKGROUND OF THE INVENTION

The present invention relates to an installation tool for use in installing a spring rail fastener, and in particular a fastener of the type defined in French patent application No. 87 13 860.

When in its installed position, that fastener bears vertically against the flange of the rail and it is held by one of its lengths which is parallel to the rail in an anchoring insert that is fixed to a tie (or "sleeper") on one side of the rail.

To install the fastener, it is necessary to deform a portion of the fastener elastically using mechanical means of low power.

Presently known devices include hooks that are extended by rods on which traction is exerted for the purpose of deforming the fastener.

Nevertheless, such devices tend to damage the fastener, in particular in zones where it is subjected in operation to large internal mechanical stresses. An object of the present invention is to remedy the above drawbacks.

SUMMARY OF THE INVENTION

According to the invention, this object is achieved by means of a tool for installing a spring rail fastener as defined in French patent application No. 87 13860, the fastener bearing vertically against the flange of the rail and being retained by one of its lengths which is parallel to the rail in a horizontal housing of an anchoring insert, the tool being characterized in that it comprises a main arm whose bottom end is provided with a toe adapted to fit over one of the angled axial ends of the fastener, said main arm being connected near its bottom end, above its toe and by means of a hinge having a transverse pin, to a secondary arm comprising a short first length adapted to be inserted into the housing of the insert, a second length forming a U-shape bent through 180°, a third length that is substantially parallel to the first length and on which the hinge is mounted, and a fourth length extending outwardly and downwardly in inclined manner relative to the third length and terminating in a curved zone.

According to a characteristic of the invention, the main arm and the first, second, and third lengths of the secondary arm are substantially coplanar.

In a variant embodiment, the first and fourth lengths of the secondary arm are offset on respective sides of a plane defined by the main arm and the third length of the secondary arm.

BRIEF DESCRIPTION OF THE DRAWINGS

The invention will be better understood on reading the following description given with reference to the accompanying drawings in which FIG. 1 is a perspective view of one embodiment of the tool of the invention.

DESCRIPTION OF PREFERRED EMBODIMENTS

The tool shown in the figure is designed to install a fastener A as defined, for example, in French patent No. 87 13860, so that it bears against the flange P of a rail R.

The fastener A is held in its operative position where it bears against the rail by means of one of its lengths that is parallel to the rail and that is held in a horizontal housing L in an anchoring insert I fixed to the tie T.

The tool of the invention comprises a main arm 1 whose bottom end 1*a* is provided with a toe 2 adapted to fit over one of the angled axial ends A1 of the fastener A.

The length of the main arm 1 is such as to facilitate the work of the operator and enable a lever arm force to be obtained that is large enough to deform the fastener A elastically and push it into the housing L.

The toe 2 has a top face 2*a* perpendicular to the main arm 1 and two parallel side faces 2*b* that are perpendicular to the top face 2*a* and that between them define a housing of sufficient size to receive the angled end A1 of the fastener that is to be positioned in the housing L of the insert I via its insertion end.

Near its bottom end, but above the toe 2, the main arm 1 is hinged to a secondary arm 10 by means of a hinge 3 having a perpendicular transverse pin 3*a*.

The secondary arm 10 comprises four lengths 11 to 14. The first length 11 is relatively short, but it must be long enough to enable it to be inserted in and then to bear against the inside of the housing in the Insert I that is provided for retaining the fastener A, but to be inserted into the housing from its end opposite to its insertion end.

The second length 12 is U-shaped, being angled through 180°.

The third length 13 is substantially parallel to the first length 11 and includes the hinge 3 for connection to the main arm 1. The fourth length 14 extends in sloping manner outwards and downwards (in its in-use position) relative to the third length 13, terminating in a curved zone adapted to bear vertically against the bottom edge of the flange P of the rail R.

The main arm 1, and the first, second, and third lengths 11, 12, and 13 of the secondary arm 10 are coplanar.

The fastener A is installed by exerting thrust motion thereon in a direction substantially parallel to the rail R and at its angled axial end A1 which is engaged in the insertion end of the housing L in the Insert I, the force being exerted by means of the toe 2 actuated by the main arm 1 forming a lever arm after previously firstly locking the length 11 of the secondary arm 10 in the housing L of the insert via its ends opposite to its insertion end for the fastener A, and secondly by displacing the length 14 that bears against the flange of the rail.

Rotating the main arm about the pin 3*a* of the hinge 3 in the direction shown by the arrows in the figure causes a thrust force to be exerted on the fastener A and a traction force to be exerted on the Insert I, these two forces being directed along the direction of the rail.

These forces are associated with a resilient deformation force of the portion of the fastener that bears against the flange of the rail.

In a variant embodiment (not shown), the first length 11 and the fourth length 14 of the secondary arm 10 are offset on opposite sides of the plane defined by the main arm 1 and the third length 13 of the secondary arm 10 so as to achieve particularly stable positioning of the secondary arm 10 by means of the fourth length 14 bearing against the flange of the rail.

What is claimed is:

1. A tool for installing a spring rail fastener for a rail, the fastener bearing vertically against the flange of the rail and being retained by one of its lengths which is parallel to the rail in a horizontal housing of an anchoring insert, the tool comprising a main arm whose bottom end is provided with a toe adapted to fit over one of the angled axial ends of the fastener, the main arm being connected near its bottom end, above its toe, and by means of a hinge having a transverse pin, to a secondary arm comprising a short first length adapted to be inserted into the housing of the insert, a second length forming a U-shape bent through 180°, a third length that is substantially parallel to the first length and on which the hinge is mounted, and a fourth length extending outwardly and downwardly in inclined manner relative to the third length and terminating in a curved zone adapted to bear vertically against the rail.

2. A tool according to claim 1 wherein the main arm and the first, second, and third lengths of the secondary arm are substantially coplanar.

3. A tool according to claim 1 wherein the toe has a top face perpendicular to the main arm and two side faces that are parallel and perpendicular to the top face, defining between them a space which forms a housing for one of the angled ends of the fastener.

* * * * *

UNITED STATES PATENT AND TRADEMARK OFFICE

CERTIFICATE OF CORRECTION

PATENT NO. : 5,458,065

DATED : October 17, 1995

INVENTOR(S) : Cailliau

It is certified that error appears in the above-indentified patent and that said Letters Patent is hereby corrected as shown below: On the title page, item [19] &

Item 75: Inventors; change "Catlliau" to

--Cailliau--.

Signed and Sealed this

Twenty-fifth Day of June, 1996

Bruce Lehman

*Attest:*

BRUCE LEHMAN

*Attesting Officer*

*Commissioner of Patents and Trademarks*